United States Patent [19]

Burns

[11] Patent Number: 4,918,779

[45] Date of Patent: Apr. 24, 1990

[54] FOOT SPRAYING AND CLEANING DEVICE

[76] Inventor: Matt B. Burns, P.O. Box 958, Hanalei, Haena County, Hi. 96714

[21] Appl. No.: 315,807

[22] Filed: Feb. 27, 1989

[51] Int. Cl.[5] ..... A61H 33/00; A47K 7/03; A46B 11/06

[52] U.S. Cl. ..... 15/104.92; 4/606

[58] Field of Search ..... 15/104.92, 21 R, 21 B, 15/21 C, 21 D, 97 R, 30, 31; 4/606

[56] References Cited

U.S. PATENT DOCUMENTS

| | | | |
|---|---|---|---|
| 3,416,178 | 12/1968 | James | 15/104.92 |
| 3,548,439 | 12/1970 | Berst | 15/104.92 |
| 3,973,286 | 8/1976 | Logan | 15/104.92 |

FOREIGN PATENT DOCUMENTS

| | | | |
|---|---|---|---|
| 625299 | 9/1961 | Italy | 15/104.92 |

*Primary Examiner*—Edward L. Roberts
*Attorney, Agent, or Firm*—H. Jay Spiegel

[57] ABSTRACT

Disclosed is an improved foot spraying and cleaning device which includes a pair of opposed facing brushes, each of which has embedded therein an elongated bar having a plurality of fluid outlets therein, with the outlets of the respective bars facing one another. Flow of fluid through the bars is controlled by a foot-actuated valve mechanism. Aesthetic housings may be provided for the brushes which may be made to resemble shells.

11 Claims, 3 Drawing Sheets

FOOT SPRAYING AND CLEANING DEVICE

BACKGROUND OF THE INVENTION

The present invention relates to an improved foot spraying and cleaning device. In the prior art, it is known to provide foot spraying devices. U.S. Pat. No. D168,613 to Denyssen discloses a foot spraying device which has an ornamental design including a plurality of elongated ports. Furthermore, devices including brushes designed to be in contact with shoes are also well known, as taught by U.S. Pat. No. 3,066,338 to Nappi.

However, Applicant is unaware of any prior art teaching the combination of opposed, facing, stationary brushes, each of which has embedded therein an elongated spray bar having a plurality of outlet nozzles with fluid flow therethrough being controlled by a foot-actuated valve.

SUMMARY OF THE INVENTION

The present invention relates to an improved foot spraying and cleaning device. The present invention includes the following interrelated aspects and features:

(a) In a first aspect, the present invention includes a base having mounted thereon a fluid piping system including two upstanding elongated spray bars, each of which has a plurality of spaced outlet openings, with the outlet openings of one spray bar facing the outlet openings of the other spray bar.

(b) Flow of fluid through the spray bars is controlled by a foot-operated valve. In a first embodiment, the valve is reciprocatory whereas in a second embodiment, the valve is rotary.

(c) Each respective spray bar is embedded within a similarly elongated brush which may, if desired, be aesthetically covered with a housing made to resemble a half shell.

As such, it is a first object of the present invention to provide an improved foot spraying and cleaning device.

It is a further object of the present invention to provide such a device wherein spraying of fluid on one's feet is controlled by a foot-operated valve.

It is a further object of the present invention to provide such a device wherein the brushes thereof are aesthetically covered by simulated half shells.

These and other objects, aspects and features of the present invention will be better understood from the following detailed description of the preferred embodiments when read in conjuction with the appended drawing figures.

SPECIFIC DESCRIPTION OF THE PREFERRED EMBODIMENTS

Figure 1:
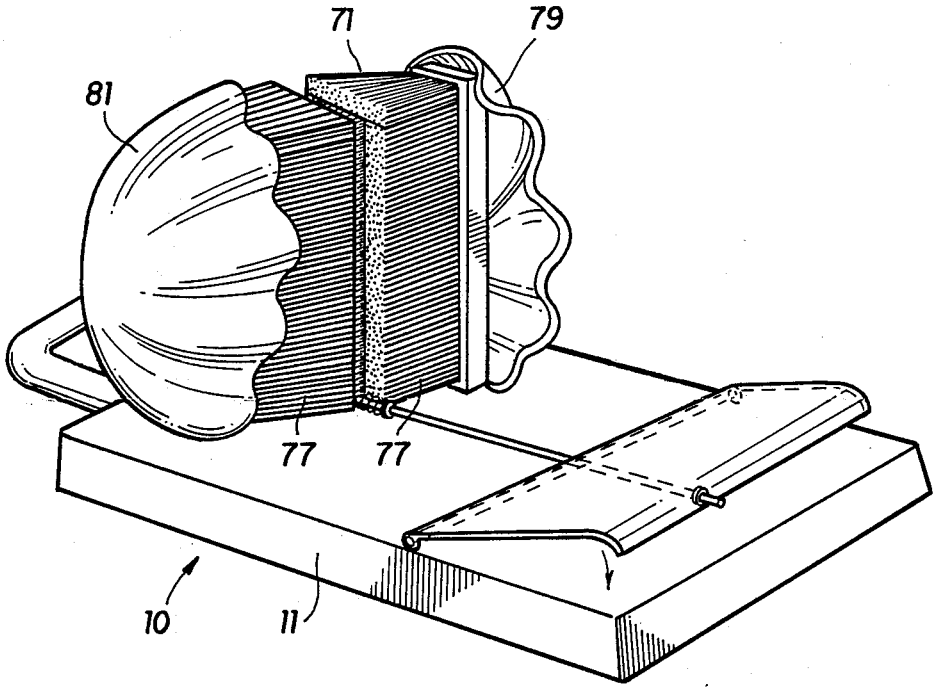
FIG. 1 shows a perspective view of the present invention.
Figure 3:
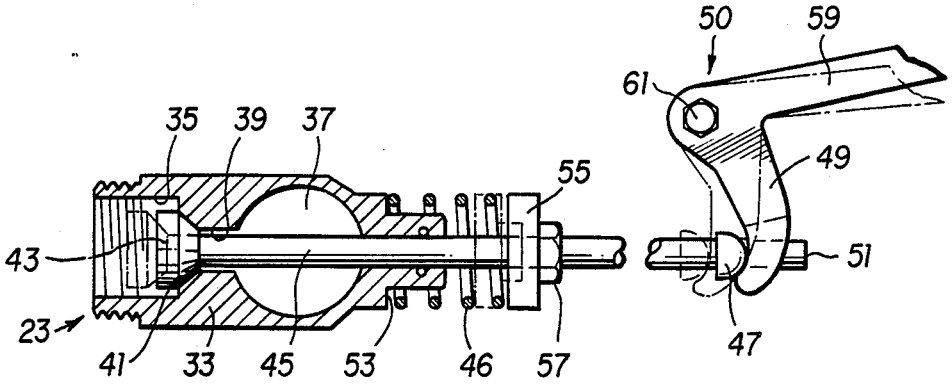
FIG. 3 shows a cross-sectional view along the line 3—3 of FIG. 2.
Figure 2:
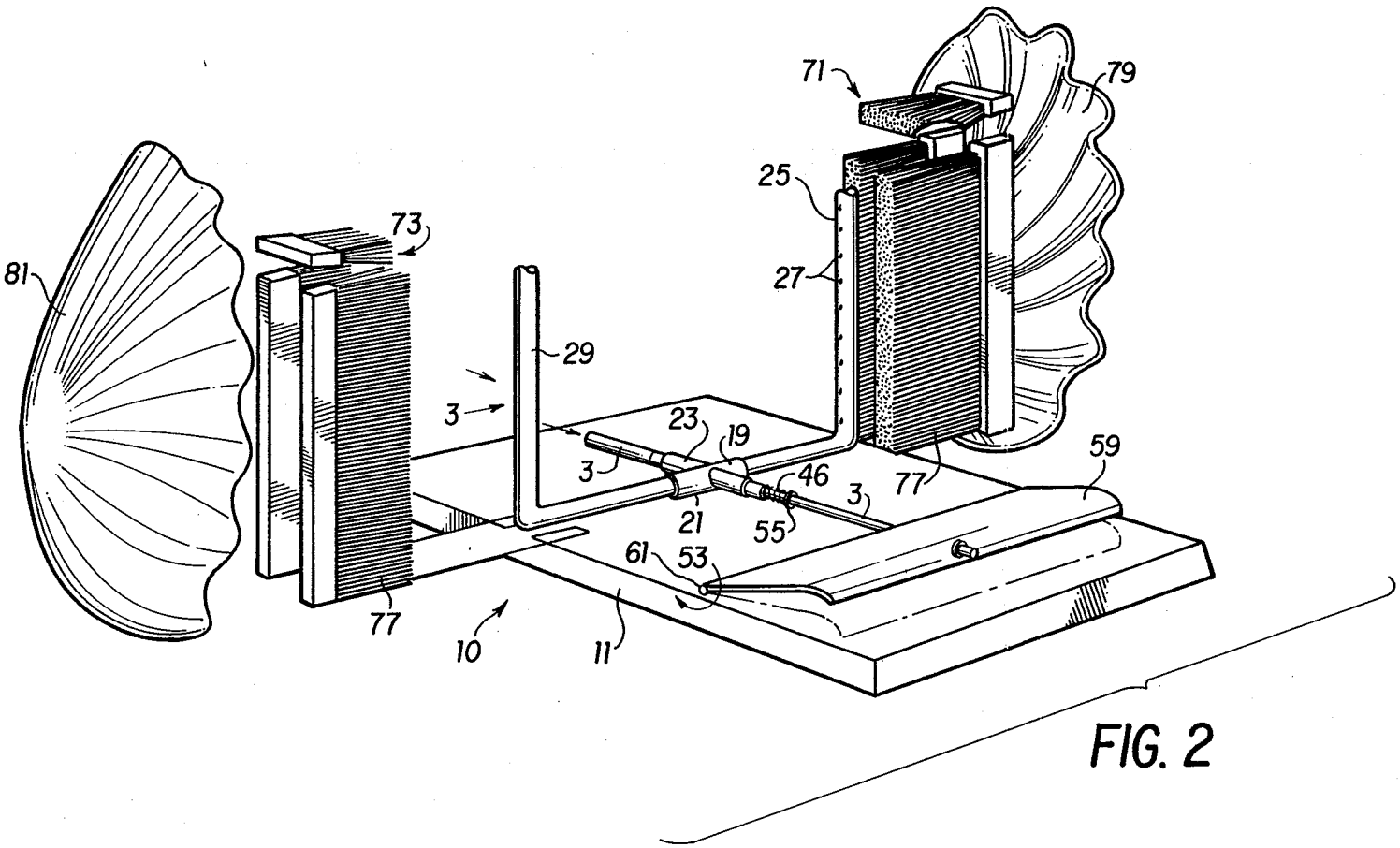
FIG. 2 shows an exploded perspective view from the same perspective as shown in FIG. 1, with certain parts broken away to show detail.

With reference, first, to FIGS. 1–3, a first embodiment of the present invention is generally designated by the reference numeral 10 and is seen to include a generally-rectangular base 11 on which is mounted a fluid piping system 13 including an inlet coupling 15, an inlet pipe 17, outlet pipes 19, 21 and a valve 23 interposed between the inlet pipe 17 and, respectively, the outlet pipes 19 and 21. The outlet pipe 19 terminates with a spray bar 25 having a plurality of outlets 27 therethrough, while the outlet pipe 21 terminates at a spray bar 29 having a plurality of outlets (not shown) identical to the outlets 27. As should be understood, the outlets in the spray bar 29 face the outlets 27 of the spray bar 25.

With further reference to FIGS. 2 and 3, it is seen that the valve 23 has a housing 33 with an inlet chamber 35 and an outlet chamber 37 which are separated by a port 39 including a valve seat 41 which is selectively engaged by a valve head 43. The valve head 43 has connected thereto a valve stem 45 which preferably has a raised shoulder 47 allowing interconnection with an actuator 50 by virtue of opening 48 through the arm 49 of the actuator 50 which fits over the end 51 of the stem 45.

As should be understood, pivoting movements of the actuator 50 will result in reciprocation of the valve head 43 between the closed position shown in the full lines in FIG. 3 and the open position thereof which is shown in phantom therein.

The actuator 50 includes a foot pedal 59 is connected to the arm 49 in angular relation thereto and the arm 49 and pedal 59 are mounted on a pivot 61 in such a manner that pushing down on the pedal 59 with one's foot will result in reciprocation of the stem 45 and valve head 43 to the open position whereas release of pressure by the foot on the pedal 59 will allow the spring 46 (FIG. 3) to return the valve head 43 to its closed position as seen in the full lines in FIG. 3. The spring 46 is captured between a shoulder 53 on the housing 33 and a washer 55 retained on the stem 45 by a nut 57 retained on the stem 45 by complimentary threads (not shown).

With further reference to FIGS. 1 and 2, it is seen that mounted on the base 11 are two brushes 71 and 73, each of which is comprised of a backing portion 75 and a plurality of bristles 77 extending therefrom.

As best seen in FIG. 2, the bristles are formed in two parallel configurations allowing installation of each respective brush 71, 73 over a respective spray bar 29, 25. Thus, when a person's foot is placed between the brushes 71, 73, the respective bristles 77 may brush sand and other debris off the user's foot while depression of the actuator 59 will cause flow of fluid out the openings 27 through the valve 23 to cause water to be sprayed on the user's foot to aid in the cleaning process.

With further reference to FIGS. 1 and 2, if desired, the brushes 71, 73 may be aesthetically covered by housings made in the likeness of sea shells. These housings are designated by the reference numerals 79 and 81 in the Figures.

Figure 4:
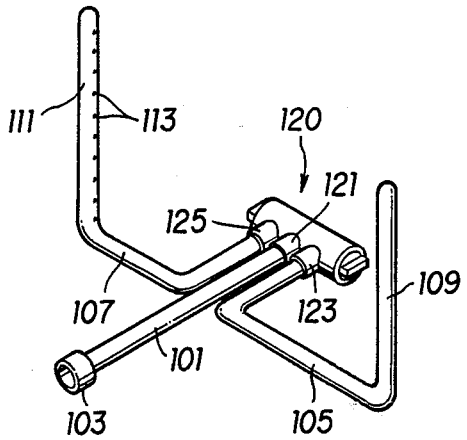
FIG. 4 shows a perspective view of a further embodiment of the present invention.

With reference, now, to FIGS. 4–7, a second embodiment of the present invention will be described. With reference, first, to FIG. 4, it is seen that the fluid piping system may include an inlet pipe 101 having an inlet fitting 103, a first outlet pipe 105 and a second outlet pipe 107, with the outlet pipe 105 terminating in a spray bar 109, and with the outlet pipe 107 terminating in a spray bar 111. As seen in FIG. 4, the spray bar 111 has a plurality of outlet openings 113 and similar openings (not shown) are also to be found on the spray bar 109 with the respective outlet openings on the spray bars 109 and 111 facing one another.

As seen in FIG. 4, the inlet 101 and outlets 105, 107 are each interconnected into an elongated valve member 120 which includes an inlet port 121 connected to the inlet pipe 101 and respective outlet ports 123 and 125 which are respectively interconnected with the outlet pipes 105 and 107.

Figure 5:
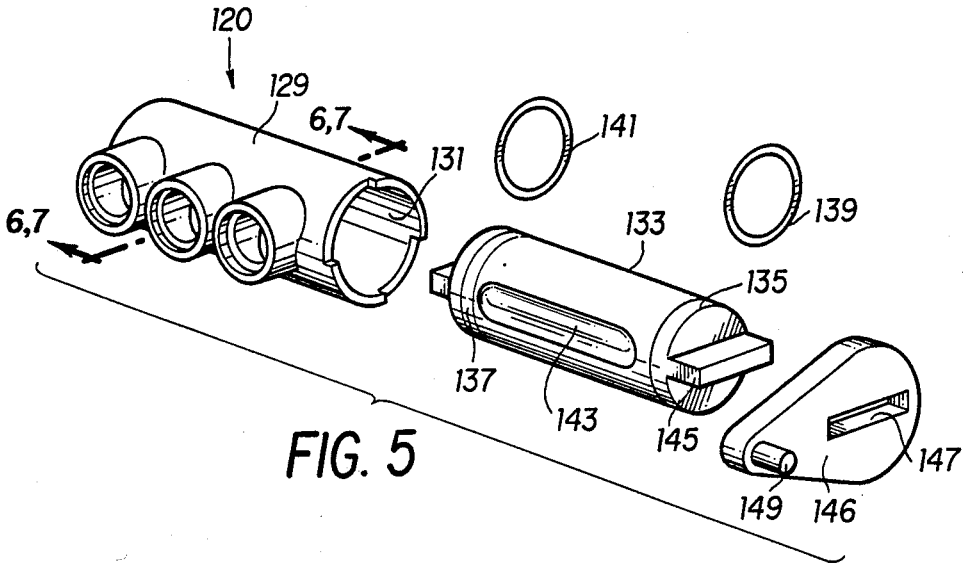
FIG. 5 shows an exploded perspective view of the valve of the embodiment of FIG. 4.

With reference to FIG. 5, it is seen that the valve body 120 includes a housing 129 having an internal chamber 131 into which may be rotatably installed a valve head 133 having a generally cylindrical elongated configuration with grooves 135, 137 at opposed ends thereof designed to receive flexible O-rings 139, 141 so as to provide axial sealing of the valve head 133.

Figure 6:
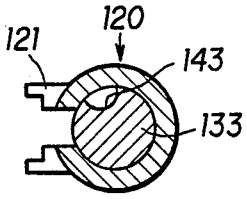
FIG. 6 shows a cross-sectional view along the line 6—6 of FIG. 5 showing the value in a closed position thereof.
Figure 7:
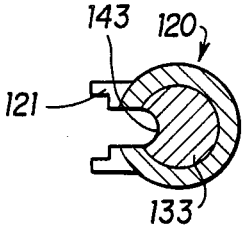
FIG. 7 shows a cross-sectional view along the line 7—7 of FIG. 5 showing the value in a open position thereof.

The valve head 133 includes an elongated groove 143 which extends sufficiently longitudinally to encompass the ports 121, 125 and 129 when aligned therewith to allow free fluid communication between the inlet port 121 and the outlet ports 125, 123. A flat projection 145 is provided at one end of the valve head 133 and is designed to be engaged with a slot 147 formed on an actuator arm 146 which includes an upstanding projection 149 designed to be interconnected with a linkage which may be attached to a foot pedal and actuating arm such as that which is shown in FIGS. 2 and 3. In particular, pivoting of an arm corresponding to the actuator arm 49 shown in FIG. 2 will result, via an appropriate linkage in rotation of the arm 146 and thereby rotation of the valve head 133 between open and closed positions. FIG. 6 shows the valve head 133 in a closed position whereas FIG. 7 shows the valve head 133 in an open position thereof.

A spring (not shown) is interposed between the actuator arm 146 and the housing 129 of the valve 120 to bias the valve head 133 to the closed position thereof in an analogous manner to the bias to the closed position of the valve head 43 of the embodiment, best illustrated in FIG. 3, by virtue of the spring 46. In this way, when the foot pedal is released, the spring will move the valve head 133 to the position shown in FIG. 6, whereas depression of the pedal will result in rotation of the valve head 133 to the position shown in FIG. 7 wherein the recess 143 and the valve head 133 will be aligned with the ports 121, 125 and 129 to allow free flow of water therebetween and thence out the spray bars 109, 111. For best operation the pedal used with the valve illustrated in FIGS. 4–7 should have the pivot rearwardly located as compared to the forward location of the pivot 61. The arm corresponding to the arm 49 would also be rearwardly located depending downwardly from the rear of the pedal rather than from the front thereof.

Through the use of the present invention in either of its embodiments, it should be understood that the feet may, one at a time, be simultaneously cleaned and brushed so that they are free of sand or other debris when one uses the present invention when leaving the beach or other location where sand or other debris may be deposited on the feet of the user.

As such, an invention has been disclosed in terms of its preferred embodiments which fulfill each and every one of the objects of the invention as set forth hereinabove and provide a new and improved foot spraying and cleaning device which is unique and effective in use. Of course, various changes, modifications and alterations in the teachings of the present invention may be contemplated by those skilled in the art without departing from the intended spirit and scope of the present invention. As such, it is intended that the present invention only be limited by the terms of the appended claims.

I claim:

1. An improved foot cleaning device, comprising:

(a) a base having a fluid piping system mounted thereon, said fluid piping system including an inlet and at least one outlet comprising an elongated spray bar having a plurality of outlet orifices therein, and valve means interposed between said inlet and said at least one outlet;

(b) an actuator for said valve means including a foot pedal on said base and linkage means connected between said foot pedal and said valve means for transferring pedal movements into actuating movements of said valve means between respective open and closed positions; and (c) said spray bar being embedded within a brush mounted on said base.

2. The invention of claim 1, wherein said actuator includes means biasing said valve means in a direction of closing.

3. The invention of claim 2, wherein said valve means is a reciprocating valve.

4. The invention of claim 2, wherein said valve means is a rotary valve.

5. The invention of claim 1, wherein said at least one outlet comprises two outlets, each having a spray bar with a plurality of outlet orifices herein, orifices of one of said spray bars facing respective orifices of the other of said spray bars.

6. The invention of claim 5, wherein each said spray bar is embedded within a brush.

7. The invention of claim 1, wherein said brush is encased within a housing.

8. The invention of claim 7, wherein said housing is made to resemble a sea shell.

9. The invention of claim 6, wherein each said brush is encased within a housing.

10. The invention of claim 9, wherein each said housing is made to resemble a sea shell.

11. The invention of claim 1, wherein said linkage means includes an elongated rod.

* * * * *